US005450672A

United States Patent [19]

Fortin

[11] Patent Number: 5,450,672

[45] Date of Patent: Sep. 19, 1995

[54] FLEXIBLE MATERIAL WALL TRIMMING TOOL

[76] Inventor: Conrad Fortin, 534 Main St., Van Buren, Me. 04785

[21] Appl. No.: 223,633

[22] Filed: Apr. 6, 1994

[51] Int. Cl.[6] ..... B26A 29/06

[52] U.S. Cl. ..... 30/273; 30/294; 30/339

[58] Field of Search ..... 30/294, 293, 315, 339, 30/317

[56] References Cited

U.S. PATENT DOCUMENTS

| | | | |
|---|---|---|---|
| 3,382,579 | 5/1968 | Prater . | |
| 3,395,453 | 8/1968 | Prater . | |
| 3,504,435 | 4/1970 | Sloboda | 30/294 |
| 3,581,397 | 6/1971 | Kochanowski | 30/293 |
| 3,653,124 | 4/1972 | Evans | 30/293 |
| 3,844,038 | 10/1974 | Kelly et al. | 30/293 |
| 3,991,467 | 11/1976 | Yokoyama | 30/294 |
| 4,064,626 | 12/1977 | Meshulam et al. | 30/294 |
| 4,549,351 | 10/1985 | Stanbery et al. | 30/294 |
| 5,189,795 | 3/1993 | Fortin . | |

*Primary Examiner*—Kenneth E. Peterson
*Attorney, Agent, or Firm*—Daniel H. Kane

[57] ABSTRACT

A flexible material wall trimming tool (10) cuts flexible material (32) such as flexible flooring material and flexible wall cove material at the intersection of a floor (34) and a wall (35). An elongate low profile block body (12) is formed with a bevel angle pusher surface (15) at the back end (14) of the block body (12) for pushing the wall trimming tool in the elongate cutting direction (18) using the palm of a hand. The bevel angle pusher surface (15) delivers force components downward against the floor (34) and sideways against the wall (35) for accurate cutting. A blade slot (20) is formed on the cutting side (28) of the block body (12) near the back end (14). The blade slot (20) is also formed at a compound angle. A blade holder (24) rigidly clamps a blade (22) in the blade slot (20) at the compound angle. A tool angle trim adjuster (42) is slidably received in a tool angle trim slot (40) on the opposite side (38) of the block body (12) from the cutting side (28). The tool angle trim adjuster (42) is used for adjusting the tightness of fit of flexible material (32) cut by the tool (10). A finger grip block (50) is formed on top of the block body (12) for gripping the tool (10). Overall the tool (10) is approximately the size of a hand for stable manual control and accurate cutting.

10 Claims, 4 Drawing Sheets

FLEXIBLE MATERIAL WALL TRIMMING TOOL

TECHNICAL FIELD

This invention relates to a new wall trimming tool for accurately trimming flexible or soft flooring materials and wall covering cove materials at the intersection of a floor and wall. The new wall trimmer is adapted for cutting soft residential linoleum and sheet vinyl floor coverings, glue down carpets and other soft carpet materials including carpets with rubber or vinyl backing and carpet tiles, and wall covering materials such as vinyl or rubber cove material covering the baseboard area of a wall. The new wall trimming tool is designed for manual operation and provides accurate control and cutting at a floor/wall intersection. The trimmer is adjustable to provide the desired tightness of fit and to match a flexible floor covering and wall cove covering with a desired trim fit at the floor/wall intersection.

BACKGROUND ART

In U.S. Pat. No. 5,189,795 issued Mar. 2, 1993, the present inventor describes a precision linoleum edge trimming tool for trimming the edge portions of heavy gauge industrial or commercial linoleum at a bordering wall. The linoleum edge trimming tool described in U.S. Pat. No. 5,189,795 is intended for handling the thickest and stiffest grades of linoleum and is constructed accordingly. For example the heavy gauge linoleum trimmer is formed with a throat or channel for receiving and guiding the linoleum floor covering. External brackets and related design features brace against the wall and floor while holding the heavy gauge linoleum to be cut.

The present invention is directed to a new wall trimming tool for cutting flexible or soft residential gauge floor covering materials and wall cove materials. It should therefore be possible to use a lighter and simpler tool in this context.

The wall trimming tool of which Applicant is aware for currently cutting residential grade flexible or "soft" floor and wall covering materials is the Congoleum T040 "ACCU-TRIMMER" (TM) sheet vinyl wall trimmer. The Congoleum wall trimmer is described in U.S. Pat. Nos. 3,395,453 and 3,382,579. According to the design and construction of this tool, a curved metal surface is provided for abutting against the floor and wall at the floor/wall intersection. Two slanted blades project from the curved surface at the floor/wall intersection. An upright handle extends above the Congoleum tool for manually holding and guiding the tool along the floor/wall intersection. The blades are held in place by a spring loaded blade holder.

A primary disadvantage of the currently available tool described in U.S. Pat. Nos. 3,395,453 and 3,382,579 is that the tool is inherently unstable. While holding and guiding the tool using the upright handle it is difficult to prevent the tool from swaying from side to side. The position of the handle makes it difficult to maintain the tool in a flat position on the floor. Furthermore the spring loaded blades can move over a range of lateral positions under spring tension further aggravating inaccurate cuts caused by the instability of the tool.

OBJECTS OF THE INVENTION

It is therefore an object of the present invention to provide a new wall trimming tool simplified in construction and weight for use in cutting residential grade floor coverings and wall trims such as flexible and soft linoleum, vinyl, carpet and carpet tile materials including multiply materials formed with a flexible or soft backing.

Another object of the invention is to provide a wall trimming tool with a low center of gravity that is compact and inherently stable for accurate cutting of flexible floor and wall coverings at a floor/wall intersection. A feature of the new tool is that it delivers components of force against the floor and intersecting wall to assure stable cutting and gliding.

A further object of the invention is to provide a compact low profile simplified wall trimming tool that is adjustable for varying the lateral angle of the tool to assure a desired trim fit or other tight fit at the intersection by the flexible material cut by the wall trimming tool.

DISCLOSURE OF THE INVENTION

In order to accomplish these results the invention provides a flexible material wall trimming tool for cutting a flexible material such as flexible or soft flooring material and flexible or soft cove material at the intersection of a floor and a wall. The tool achieves the desired trim fit as follows.

The wall trimming tool is constructed with an elongate low profile block body formed with a bevel angle pusher surface at the back end of the block body. The bevel angle pusher surface is used for pushing the wall trimming tool in the elongate direction using the palm of the hand. The bevel angle pusher surface is constructed to deliver a component of force downward at the bottom of the block body against the floor and sideways at a cutting side of the block body against a wall. The components of force delivered by the bevel angle pusher surface on the block body maintains the wall trimming tool at the intersection of the floor and wall for accurate cutting.

A blade slot is formed on the cutting side of the block body near the back end of the block body. The blade slot is formed at an angle with the lower end of the blade slot extending toward the back end of the block body at the intersection of the bottom and cutting side of the block body.

A cutting blade and blade holder are formed in a configuration complementary to the blade slot. The blade is slidable in the blade slot for adjusting the length of the cutting end of the blade exposed at the lower end of the blade slot. A blade holder rigidly clamps the blade in the blade slot with the cutting end of the blade extending a selected distance beyond the lower end of the blade slot at the intersection of the bottom and cutting side of the block body. The blade slot and blade holder are constructed to secure the blade with the cutting edge at a desired front to back angle on the cutting side of the block body for cutting flexible material of specified thickness or specified number of plys.

The block body is also formed with a tool angle trim slot on the tool angle trim adjusting side of the block body opposite the cutting side. A tool angle trim adjuster is slidably received in the tool angle trim slot. The tool angle trim adjuster is constructed for extending to different depths below the bottom of the block body for adjusting the lateral angle, that is the side to side angle of the block body and therefore the angle and position of the cutting blade clamped in the blade slot. This adjustment of the lateral angle is used for adjusting the trim fit and tightness of fit of flexible material cut by the wall trimming tool.

The wall trimming tool is also formed with a finger rest block or finger grip block formed on the top of the block body. The finger grip block permits compressing the palm of a user against the bevel angle pusher surface for facilitating manual operation of the wall trimming tool. In the preferred embodiment the combination of the block body and finger rest block are approximately the size of a hand of a user for stable manual control of the wall trimming tool and for accurate cutting.

In the preferred example the tool angle trim slot is a vertical slot and the tool angle trim adjuster is a rectangular block slidably received in the tool angle trim slot. The rectangular block is formed with a curved surface in the front end direction of travel of the trimmer to facilitate sliding over flooring materials. The blade slot is formed at a compound angle having a first angle extending from the front to back ends of the block body with the lower end of the blade slot toward the back end of the block body. The second angle extends from side to side with the lower end of the blade slot toward the cutting side of the block body. A feature of the compound angle blade slot is that the blade is rigidly mounted at desired angles both front to back and side to side.

The intersection between the bottom of the block body and the cutting side is formed with a rounded curve to accommodate flexible materials such as carpets, soft linoleum, cove material, etc.

Other objects, features and advantages of the invention are apparent in the following specification and accompanying drawings.

BRIEF DESCRIPTION OF THE DRAWINGS

FIG. 2 is an end elevation view from the front end of the wall trimming tool while

DESCRIPTION OF PREFERRED EXAMPLE EMBODIMENTS AND BEST MODE OF THE INVENTION

Figure 6A:
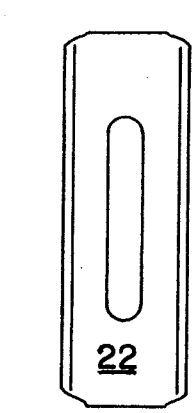
FIG. 6A is a detailed plan view of the blade.
Figure 1:
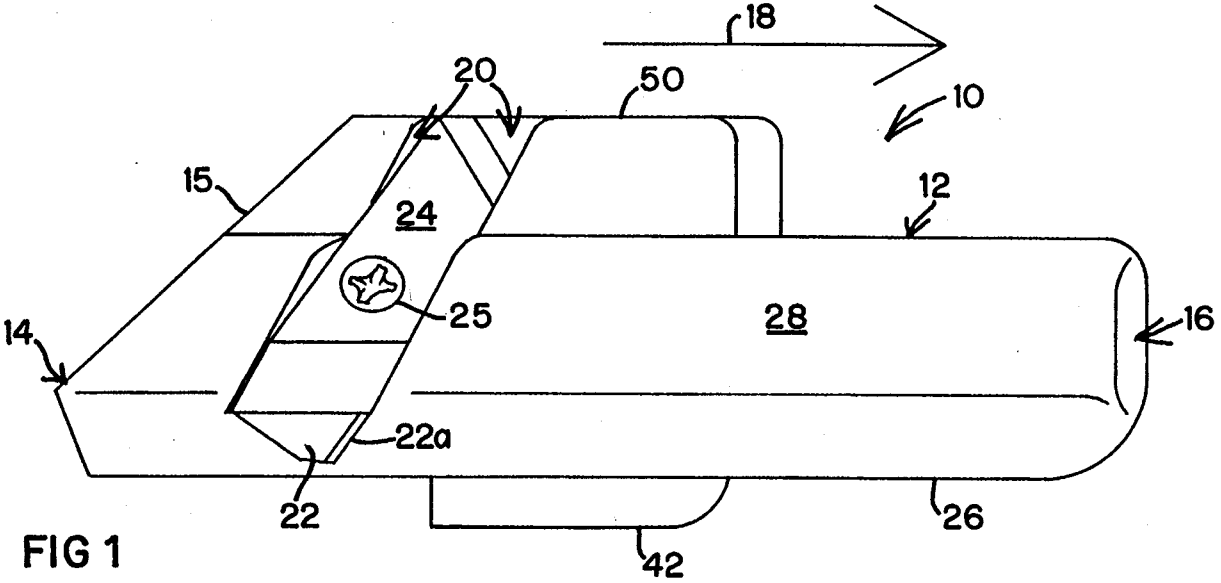
FIG. 1 is a side elevation view of the wall trimming tool from the cutting side of the wall trimming tool.

A flexible material wall trimming tool 10 according to the invention is illustrated in FIGS. 1–6. The wall trimming tool 10 is constructed from a compact low profile block body 12 with a back end 14 formed with a bevel angle pusher surface 15, and a front end 16 of generally rectangular configuration. During operation of the tool the palm of the hand rests on the bevel angle pusher surface 15 for pushing the tool in the elongate direction constituting the forward direction and direction of travel indicated by arrow 18. The bevel angle pusher surface 15 is formed with a compound angle generating components of force both downward and to the right side or cutting side in the direction of travel for maintaining the tool in stable position at the intersection of a wall and floor as hereafter described.

The cutting side 28 of the block body 12 and wall trimming tool 10 is formed with a blade slot 20 for receiving a blade 22 and blade holder 24. The blade slot is also formed at a compound angle having a first angle extending toward the front end 16 of the block body 12 at the top of the blade slot 20 and toward the back end 14 of the block body 12 at the lower end of the blade slot where the cutting edge **22*a* of blade 22 is exposed. The second angle extends toward the tool angle trim side 38 of block body 12 at the top of blade slot 22, and to the cutting side 28 of the block body 12 at the bottom of the blade slot 20. The blade holder 24 is an elongate block received in the compound angle blade slot 20. It is secured to the blade slot in a fixed position by screw 25** for rigidly clamping the blade at a desired position in the blade slot.

It is noted that the blade 22 is clamped and mounted in the blade slot 20 by the blade holder 24 without spring loading and without the use of spring elements. In this way the blade can be secured in the blade slot in a rigid and fixed position without any independent spring loaded movement of the blade. The rigid clamping of the blade assures greater accuracy for the wall trimming tool leaving the tool angle trim adjustment to the tool angle trim adjuster 42 as hereafter described.

Figure 2A:
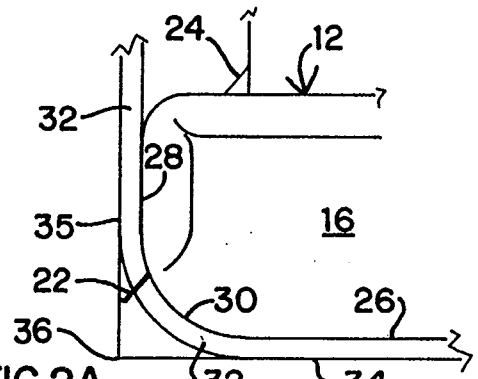
FIG. 2A is a detailed fragmentary portion of the cutting side of the wall trimming tool showing diagrammatically the cutting of, for example, a soft linoleum floor covering material at the intersection of a floor and wall.
Figure 2:
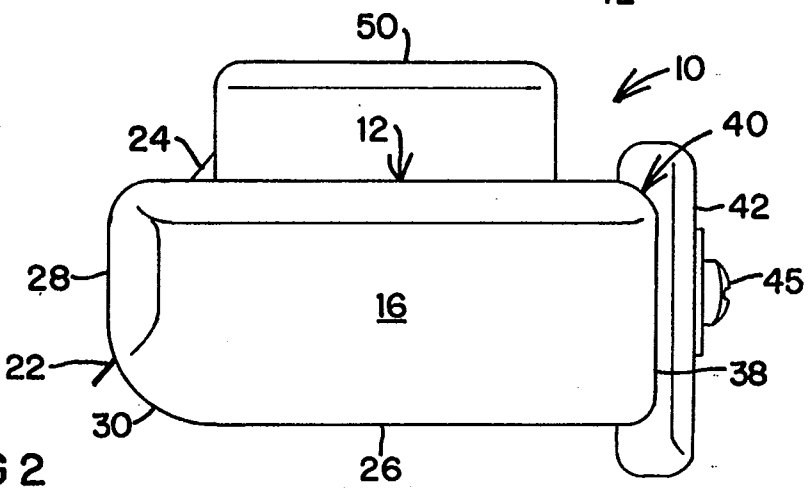
Figure 6C:
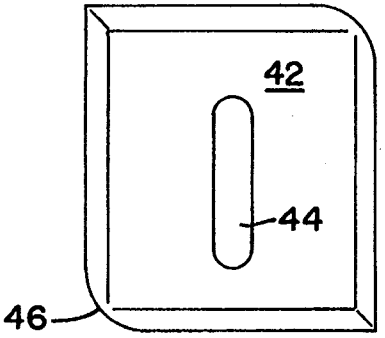
FIG. 6C is a detailed plan view of the tool angle trim adjuster.
Figure 3:
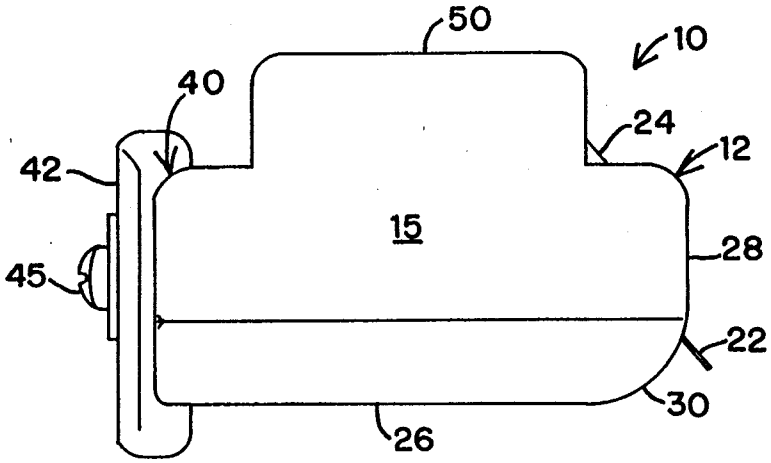
FIG. 3 is an end elevation view from the back end of the wall trimming tool.
Figure 4:
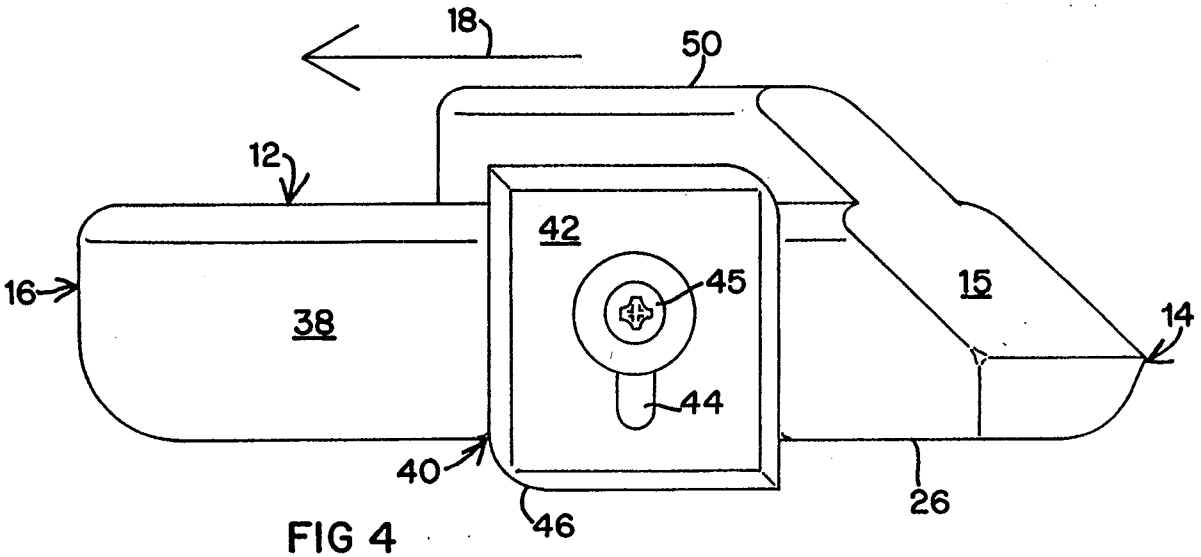
FIG. 4 is a side elevation view from the tool angle trim adjusting side of the wall trimming tool.
Figure 6B:
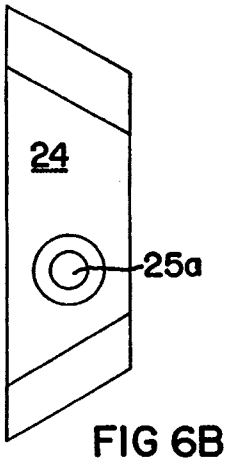
FIG. 6B is a detailed plan view of the blade holder.
Figure 5:
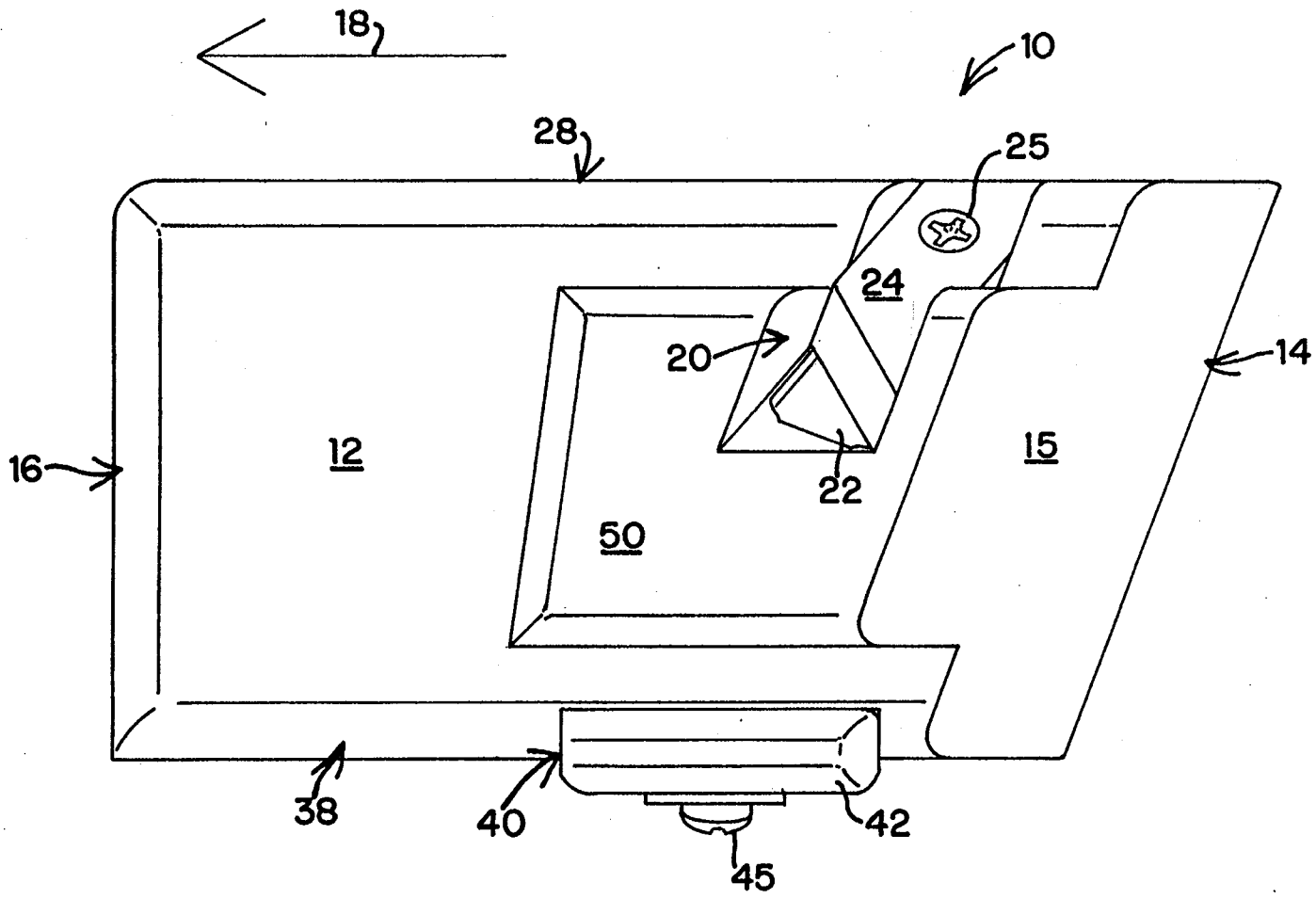
FIG. 5 is a plan view from above of the wall trimming tool.
Figure 6:
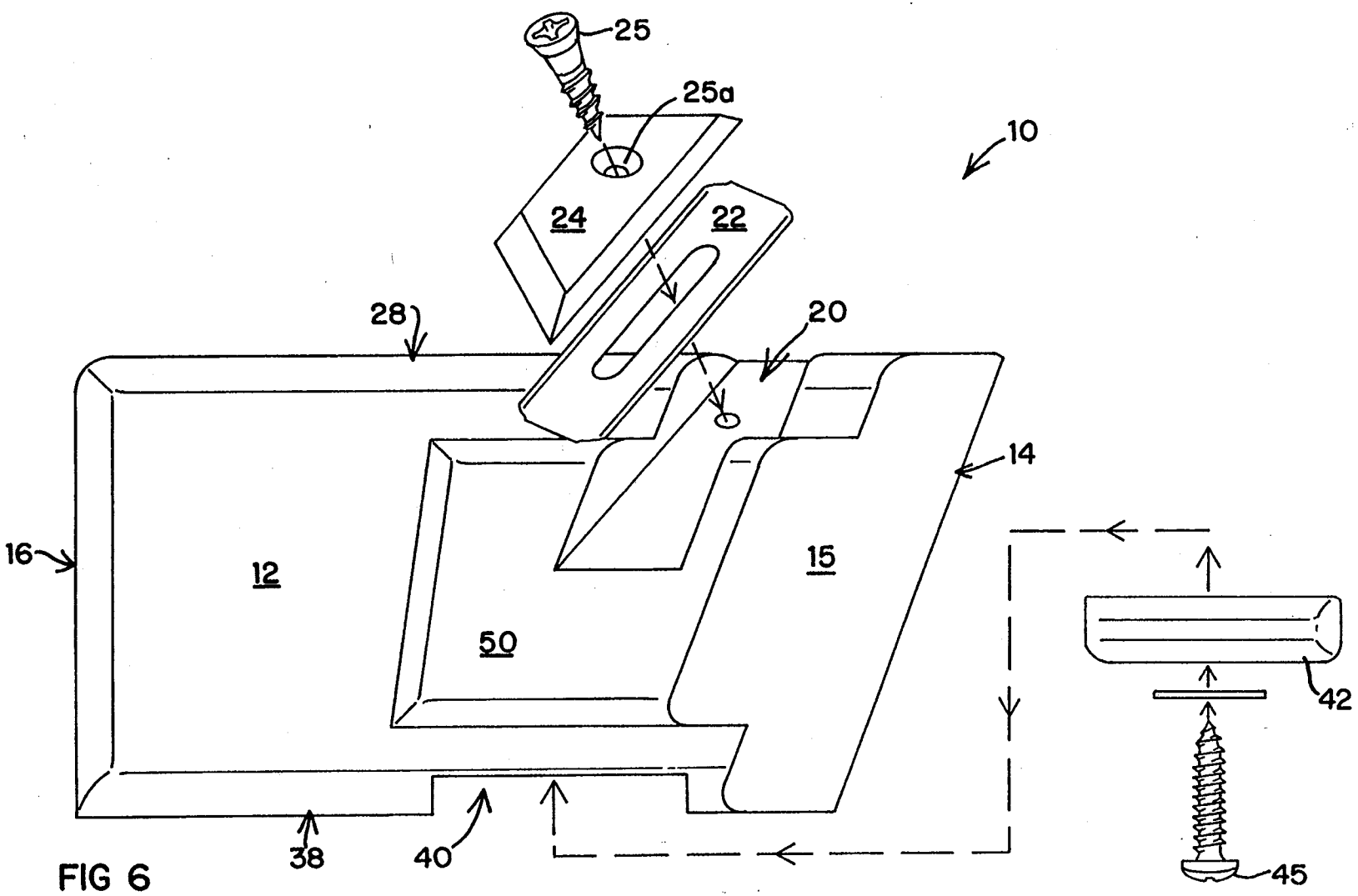
FIG. 6 is an exploded plan view of the wall trimming tool.

The intersection between the bottom 26 of block body 12 and the cutting side 28 is formed with a rounded curve 30 to accommodate flexible materials such as a flexible carpet or soft linoleum 32. As illustrated in FIG. 2A the tool is shown in cutting position at the intersection 36 of a floor 34 and a wall 35. A component of force holds the bottom 26 of the block body 12 against the floor 34 and the flexible flooring material 32 to be cut. Similarly a component of force holds the cutting side 28 of the block body 12 against the wall 35 and the excess portion of the flexible flooring material 32. The flexible material 32 thus conforms to the curve 30 at the intersection of the bottom 26 and cutting side 28 of the block body 12.

It is also noted that the blade 22 is held in the blade slot 20 by blade holder 24 at an angle of slightly greater than 90° with respect to the flexible flooring material 32. As a result the flexible flooring material 32 on the floor side 34 is cut with a slightly tapered edge extending further at the top than the bottom of the layer of material 32. This cutting configuration assures a tight fit between the flexible flooring material 32 and wall 35 with slight pressure or friction between the top of the layer 32 and wall 35.

On the opposite side of the wall trimming tool 10 from the cutting side 28 a tool angle trim slot 40 is formed in the tool angle trim adjusting side 38. The tool angle trim slot 40 is a vertical slot for slidably receiving the tool angle trim adjuster 42. The tool angle trim adjuster 42 is a rectangular block formed with a central slot 44 for sliding and extending to different depths below the bottom of the block body 12. At different depths, the adjuster 42 adjusts the lateral angle, that is the side to side angle of the block body 12 and therefore wall trimming tool 10. The tool angle trim adjuster 42 is held at the desired depth for achieving a specified angle by screw 45 and accompanying washer.

It is noted that the different settings of the tool angle trim adjuster 42 sets different angles from side to side for the wall trimming tool 10 thereby adjusting the angle and position of the blade 22. Referring to FIG. 2A, as the angle of block body 12 is adjusted laterally from side to side the changing angle and position of the blade 22 adjusts the tightness of fit of the flexible material layer 32 for abutting against the wall 35. In the case of a wall covering such as a vinyl cove material, setting the angle and position of the blade 22 by changing the position of the tool angle trim adjuster 42 can be used to set the height of the lower edge of the wall covering cove material to accommodate the particular thickness of the carpet or other floor covering.

It is also noted that the forward edge of the tool angle trim adjuster 42 in the direction of the front end 16 of the block body 12 is formed with a curved surface 46 to facilitate sliding motion of the wall trimming tool over the flooring material in the direction of travel 18.

The profile of the wall trimming tool 10 is elevated slightly above the block body 12 by a finger rest or finger grip block 50. As best understood in FIGS. 4 and 5 when the palm of the hand rests against the bevel angle pusher surface 15 the fingers of the hand rest over the front of the finger rest block 50. Tension can be applied between the fingers and palm of the hand for gripping the tool and providing greater control. In the preferred example the drawings accompanying this patent application are approximately to scale and the wall trimming tool itself is about the size of a hand. This sizing of the wall trimming tool permits overall manual mastery and control of the wall trimming tool for stable and accurate cutting.

While the invention has been described with reference to particular examples it is intended to cover all modifications and equivalents within the scope of the following claims.

I claim:

1. A flexible material wall trimming tool for cutting a flexible material such as flexible flooring material and flexible cove material at an intersection of a floor and a wall to a desired trim fit at said intersection, comprising:

an elongate low profile block body formed with a bevel angle pusher surface at a back end of the block body for pushing the wall trimming tool in a direction along the length of the elongate block body using a palm of a hand, said bevel angle pusher surface being constructed to deliver a component of force downward at a bottom of the block body against the floor and sideways at a cutting side of the block body against a wall for maintaining the wall trimming tool at the intersection of the floor and wall for accurate cutting;

a blade slot formed on the cutting side of the block body near the back end of the block body, said blade slot being formed at an angle with a lower end of the blade slot extending toward the back end of the block body at a intersection of the bottom and cutting side of the block body;

a cutting blade and blade holder formed in a configuration complementary to the blade slot, said blade being slidable in the blade slot for adjusting a length of a cutting end of the blade exposed at the lower end of the blade slot, said blade holder rigidly clamping the blade in the blade slot with the cutting end of the blade extending a selected distance beyond the lower end of the blade slot at the intersection of the bottom and cutting side of the block body, said blade slot and blade holder being constructed to secure the blade with a cutting edge at a desired front to back angle on the cutting side of the block body for cutting flexible material of specified thickness or specified number of plys;

said block body being formed with a tool angle trim slot on a tool angle trim adjusting side of the block body opposite the cutting side; and a tool angle trim adjuster slidably received in the tool angle trim slot and constructed for extending to different depths below the bottom of the block body for adjusting a lateral angle of the block body and cutting blade clamped in the blade slot, therefore adjusting a trim fit of flexible material cut by the wall trimming tool.

2. The flexible material wall trimming tool of claim 1 comprising a finger rest block formed on a top of the block body, said finger rest block being gripped by the fingers of a user whose palm is against the bevel angle pusher surface and for facilitating manual operation of the wall trimming tool.

3. The flexible material wall trimming tool of claim 1 wherein the tool angle trim slot is a vertical slot formed on the tool angle trim adjusting side of the block body opposite the cutting side and wherein the tool angle trim adjuster is a rectangular block slidably received in the tool angle trim slot.

4. The flexible material wall trimming tool of claim 1 wherein the blade slot is formed at a compound angle having a first angle extending toward a front end of the block body at a top of the blade slot and toward the back end of the block body at the lower end of the blade slot, said second angle extending toward the tool angle trim side of the block body at the top of the blade slot to the cutting side of the block body at the lower end of the blade slot, said blade holder being an elongate block received in the compound angle blade slot and being secured to the blade slot in a fixed position for rigidly clamping the blade at a desired position in the blade slot.

5. The flexible material wall trimming tool of claim 1 wherein the intersection between the bottom of the block body of the wall trimming tool and the cutting side is formed with a rounded curve to accommodate flexible material such as flexible carpet and linoleum and flexible wall trim cove material at the intersection between the floor and wall.

6. The flexible material wall trimming tool of claim 5 wherein the bottom and cutting side of the block body are formed with dry lubricant to facilitate gliding on flexible materials.

7. The flexible material wall trimming tool of claim 4 wherein the blade slot and blade holder are constructed for maintaining the blade of the wall trimming tool at about 90° relative to a flexible flooring material to be cut by the wall trimming tool.

8. A flexible material wall trimming tool for cutting a flexible material such as flexible flooring material and flexible cove material at an intersection of a floor and a wall to a desired trim fit at said intersection, comprising:

an elongate low profile block body formed with a bevel angle pusher surface at a back end of the block body for pushing the wall trimming tool in a direction along the length of the elongate block body using the palm of a hand, said bevel angle pusher surface being constructed to deliver a component of force downward at a bottom of the block body against the floor and sideways at a cutting side of the block body against a wall for maintaining the wall trimming tool at the intersection of the floor and wall for accurate cutting;

a blade slot formed on the cutting side of the block body near the back end of the block body, said blade slot being formed at a compound angle having a first angle extending toward a front end of the block body at a top of the blade slot and toward the back end of the body block at the lower end of the blade slot, said second angle extending from a tool angle trim side of the block body at the top of the blade slot to the cutting side of the block body at the lower end of the blade slot, said blade holder being an elongate block received in the compound angle blade slot and being secured to the blade slot in a fixed position for rigidly clamping the blade at a desired position in the blade slot;

a cutting blade and blade holder formed in a configuration complementary to the blade slot, said blade being slidable in the blade slot for adjusting a length of a cutting end of the blade exposed at the lower end of the blade slot, said blade holder rigidly clamping the blade in the blade slot with the cutting end of the blade extending a selected distance beyond the lower end of the blade slot at an intersection of the bottom and cutting side of the block body, said blade slot and blade holder being constructed to secure the blade with a cutting edge at a desired front to back angle on the cutting side of the block body for cutting flexible material of specified thickness or specified number of plys;

said block body being formed with a tool angle trim slot on a tool angle trim adjusting side of the block body opposite the cutting side; and a tool angle trim adjuster slidably received in the tool angle trim slot and constructed for extending to different depths below the bottom of the block body for adjusting a lateral angle of the block body and cutting blade clamped in the blade slot, therefore adjusting the trim fit of flexible material cut by the wall trimming tool;

said tool angle trim slot being a vertical slot formed on the tool angle trim adjusting side of the block body opposite the cutting side and said tool angle trim adjuster being a rectangular block slidably received in the tool angle trim slot;

and a finger rest block formed on the top of a block body, said finger rest block being gripped by the fingers of a user whose palm is against the bevel angle pusher surface and for facilitating manual operation of the wall trimming tool.

9. The flexible material wall trimming tool of claim 8 wherein the intersection between the bottom of the block body of the wall trimming tool and the cutting side is formed with a rounded curve to accommodate flexible material such as flexible carpet and linoleum and flexible wall trim cove material at the intersection between the floor and wall.

10. The flexible material wall trimming tool of claim 8 wherein the combination of the block body and finger rest block are approximately the size of a hand of a user for stable control of the wall trimming tool for accurate cutting.

* * * * *